United States Patent [19]

Hilbert et al.

[11] 4,192,968

[45] Mar. 11, 1980

[54] RECEIVER FOR COMPATIBLE AM STEREO SIGNALS

[75] Inventors: Francis H. Hilbert, Addison; Norman W. Parker, Wheaton, both of Ill.

[73] Assignee: Motorola, Inc., Schaumburg, Ill.

[21] Appl. No.: 837,258

[22] Filed: Sep. 27, 1977

[51] Int. Cl.[2] ..... H04H 5/00

[52] U.S. Cl. ..... 179/1 GS

[58] Field of Search ..... 179/15 BT, 1 GS; 325/36, 60, 456

[56] References Cited

U.S. PATENT DOCUMENTS

| | | | |
|---|---|---|---|
| 3,068,475 | 12/1962 | Avins | 179/15 BT |
| 3,080,453 | 3/1963 | Avins | 179/15 BT |
| 3,534,172 | 10/1970 | Weeda | 179/15 BT |
| 3,823,268 | 7/1974 | Modafferi | 179/15 BT |
| 4,018,994 | 4/1977 | Kahn | 179/15 BT |
| 4,037,057 | 7/1977 | Ogita et al. | 179/15 BT |

*Primary Examiner*—Douglas W. Olms

*Attorney, Agent, or Firm*—Margaret Marsh Parker; James W. Gillman

[57] ABSTRACT

An improved AM stereo receiver for receiving broadcast signal having the form $(1+L+R)\cos(\omega_c t+\phi)$ where $\phi$ is arc $\tan(L-R)/(1+L+R)$. The sum signal $(L+R)$ is demodulated in an envelope detector and coupled to a matrix. The uncorrected difference signal is demodulated in a synchronous detector, a corrector circuit derives the correction factor, and a divider circuit provides the corrected difference signal. During tuning, and until a PLL is locked on the carrier frequency, the receiver is locked into the monophonic mode and tuned on the monophonic signal. When the PLL locks, the difference signal is coupled through to the matrix for stereophonic mode operation.

15 Claims, 1 Drawing Figure

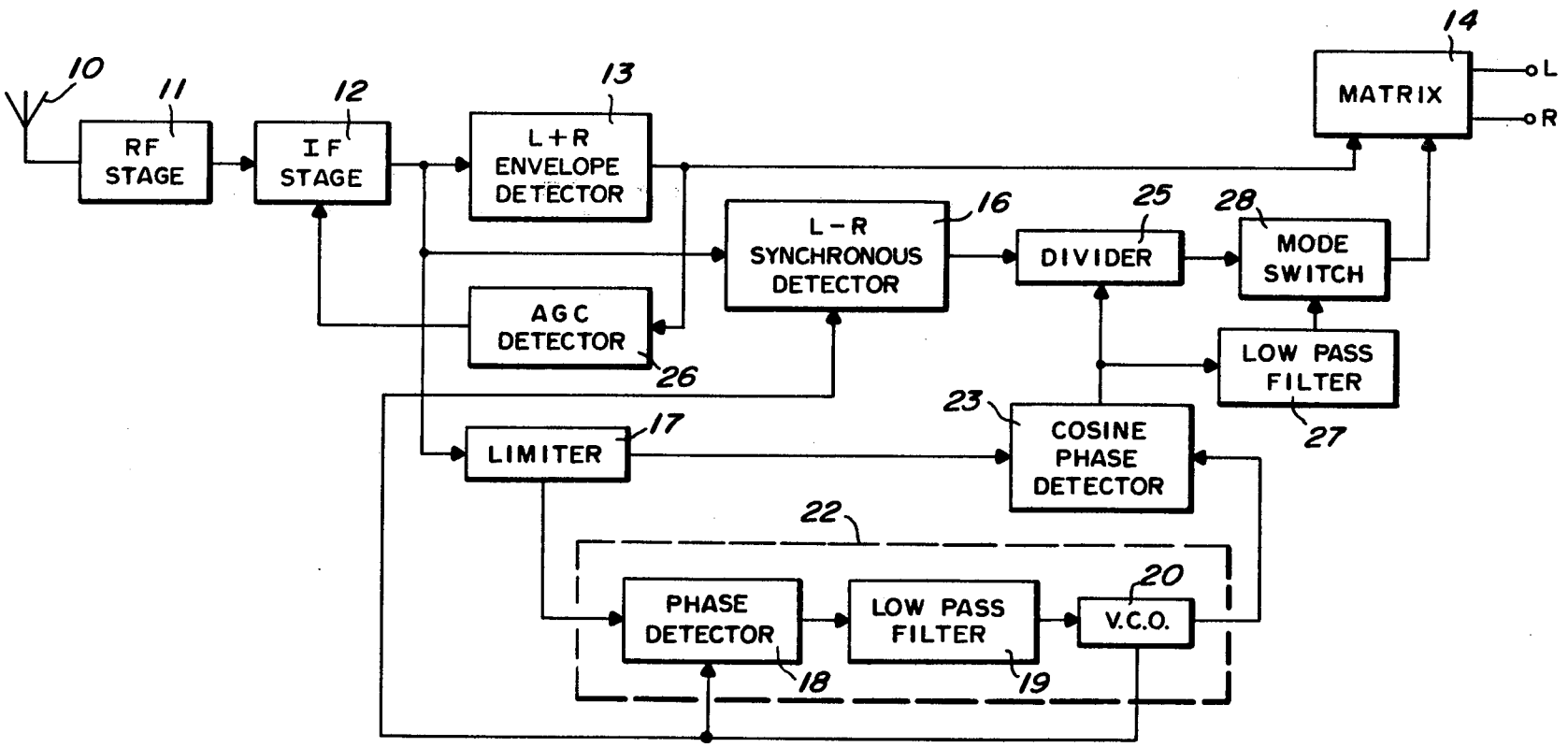
10
11
RF STAGE
12
IF STAGE
13
L+R ENVELOPE DETECTOR
14
MATRIX
L
R
16
L-R SYNCHRONOUS DETECTOR
17
LIMITER
18
PHASE DETECTOR
19
LOW PASS FILTER
20
V.C.O.
22
23
COSINE PHASE DETECTOR
25
DIVIDER
26
AGC DETECTOR
27
LOW PASS FILTER
28
MODE SWITCH

RECEIVER FOR COMPATIBLE AM STEREO SIGNALS

BACKGROUND OF THE INVENTION

The present invention relates to the field of AM stereo receivers and more particularly to a receiver having an improved tuning arrangement.

A number of systems are known which provide AM stereo transmission and reception. One of these is compatible in that the envelope of the transmitted signal contains only the sum or monophonic information (L+R) and all of the stereo information is transmitted by phase modulation of the carrier. This system, including transmitter and receiver embodiments, is shown and described in a co-pending application, Ser. No. 674,703, assigned to the same assignee as is the present invention. In the above-mentioned co-pending application, all embodiments of the stereo receiver for demodulating the compatible signal do so in a symmetrical fashion; i.e., providing signals in quadrature which are then demodulated in synchronous detectors to provide sum and difference signals and, ultimately, L and R. While all embodiments shown in said co-pending application are practical embodiments, a receiver utilizing synchronous detectors in both sum and difference channels may be difficult to tune properly, as the beats during the tuning-in period would have to be blocked out of the audio channels, and other provisions made for tuning.

SUMMARY OF THE INVENTION

It is therefore an object of the present invention to provide an improved compatible AM stereo receiver.

It is a particular object to provide improved tuning performance with a minimum of components.

In a receiver constructed in accordance with the present invention, the incoming broadcast signal will be processed in conventional fashion in RF and IF stages, then the sum signal will be demodulated in an envelope detector and coupled to a matrix. The output of the IF stage is also processed in a synchronous detector to derive a signal having the form $(L-R)\cos\phi$ where $\phi=\text{arc tan}\,(L-R)/(1+L+R)$. A corrector signal proportional to $\cos\phi$ is derived from the received signal and the output of the synchronous detector is divided by the corrector signal to produce the L−R difference signal. The corrector signal is also processed to provide a control signal for locking out the difference channel during tuning and until the phase locked loop is locked in. Both the sum and difference signals are then processed in the matrix to provide L and R outputs.

BRIEF DESCRIPTION OF THE DRAWING

The FIGURE is a block diagram of a receiver embodying the present invention.

DETAILED DESCRIPTION OF THE PREFERRED EMBODIMENT

The receiver shown in the FIGURE is designed to receive a compatible AM stereo signal from a transmitter as shown and described in the co-pending application, Ser. No. 674,703. The broadcast signal of a transmitter of the above-mentioned application is compatible with present monophonic receivers in that the carrier is amplitude modulated with a monophonic signal only (1+L+R), all stereo information being carried by phase modulation. In brief, the carrier is modulated in quadrature with the sum (L+R) and difference (L−R) signals, limited to remove amplitude variation and leaving only phase variation, then amplitude modulated with 1+L+R in the high level modulator. The output or broadcast signal is then $(1+L+R)\cos[\omega_c t+\text{arc tan}\,(L-R)/(1+L+R)]$. It is to be noted that "L" and "R" are used herein in an exemplary fashion only.

In the receiver, an antenna 10 receives a compatible AM stereo signal of the form given hereinabove, and this signal is processed in the usual fashion in RF stage 11 and IF stage 12. The monophonic or sum signal L+R is obtained by coupling the output of the IF stage to an envelope detector 13. The L+R signal is then coupled to a matrix 14. An AGC detector 26 may be coupled from the output of the envelope detector 13 back to the IF stage 12 for controlling the gain in the IF stage, as is known in the art. The output of the IF stage 12 is also coupled to a synchronous detector 16 and to a limiter 17. The synchronous detector 16 is likewise a multiplier as is known in the art, and multiplies the output signal from the IF state 12 $(1+L+R)\cos(\omega_c t+\phi)$ by the sin $\omega_c t$ output of the VCO 20. This product would then be $(1+L+R)[\sin(2\omega_c t+\phi)+\sin\phi]$. Disregarding the double frequency term, this becomes $(1+L+R)\sin\phi$ where $\phi$ is arc tan $[(L-R)/(1+L+R)]$. The sine of the angle whose tangent is $(L-R)/(1+L+R)$ is $(L-R)/\sqrt{(L-R)^2+(1+L+R)^2}$ and the cosine of this angle is $(L+L+R)/\sqrt{(L-R)^2+(L+L+R)^2}$. Substituting the sine of the angle in the signal as given above we obtained $(1+L+R)(L-R)/\sqrt{(L-R)^2+(1+L+R)^2}$ which equals $(L-R)\cos\phi$. The limiter 17 is coupled to a phase detector 18 which, with a lowpass filter 19 and a voltage controlled oscillator 20, comprises a phase locked loop (PLL) 22, an output of which (sin $\omega_c t$) is coupled to the synchronous detector 16. An output of the limiter 17, bearing only the transmitted phase information, is coupled to a cosine phase detector 23, as is an output (cos $\omega_c t$) of the phase locked loop 22 the cosine phase detector 23 is a multiplier. The instantaneous phase difference between the two carrier frequencies (unmodulated and transmitted) is detected in the cosine phase detector 23 and provides the correction information necessary to restore the original stereo signals. The desired correction information is a signal proportional to the cosine of $\phi$ or cos arc tan $[(L-R)/(1+L+R)]$ or $(1+L+R)/\sqrt{(1+L+R)^2+(L-R)^2}$. When the desired correction information is coupled to a divider 25 which also receives the output of the synchronous detector 16, the output of the divider becomes L−R, the desired stereo difference signal.

Until the receiver is properly tuned, however, the PLL 22 output is not a function of $\omega_c t$, but is a frequency which approaches $\omega_c t$ as a broadcast signal is tuned in. The difference frequency would then appear in the correction signal at the output of the cosine phase detector 23 and cause an unacceptable output in the difference channel. Therefore, the cosine phase detector 23 output is also coupled to a lowpass filter 27 (2–10 Hz) where the average DC level of the output can be used to control a mono/stereo mode switch 28. The switch 28 is a voltage-controlled switch and is set to remain in the "monophonic" position until the PLL locks in on $\omega_c t$, then switch to the "stereophonic" position.

In monophonic mode, only L−R is coupled to the matrix, and the receiver is tuned in using this monophonic audio output only. When the receiver is tuned in, and the PLL is locked on $\omega_3 t$, the DC level of the cosine phase detector 23 output, as filtered through the filter 27, is sufficiently high to switch the mono/stereo switch 28 to the stereophonic mode. This allows the L−R signal to be coupled to the matrix 14 which provides separated L and R at its ouput terminals.

In terms of signal, the output of the IF stage 12 will be proportional to $(1+L+R)\cos(\omega_c t+\phi)$ where $\phi=\text{arc tan}\,[(L-R)/(1-L-R)]$. The output of the envelope detector 13 will be proportional to L +R. The output of the limiter 17 will be proportional to $\cos(\omega_c t+\phi)$ and the outputs of the phase locked loop will be proportional to $\sin \omega_c t$ and, after phase shifting, $\cos \omega_c t$. The output of the synchronous detector 16 is the product of $(1+L+R)\cos(\omega_c t+\phi)$and $\sin \omega_c t$. Disregarding the double frequency term $2\omega_c t$, and remembering that $\phi$is arc $\tan(L-R)/(1+L+R)$, it is apparent that the product is proportional to $(L-R)\cos\phi$. The output of the cosine phase detector 23 will be proportional to $\cos\phi$ and the output of the divider 25 will thus be proportional to $(L-R)\cos\phi/\cos\phi$ or (L−R). With inputs of (L+R) and (L−R), the matrix 14 will provide L and R outputs.

Thus there has been provided an improved receiver for receiving a compatible AM stereo signal, and requiring fewer components than heretofore required. Other variations and modifications of the circuit of the invention are possible and it is intended to cover all such as fall within the spirit and scope of the appended claims.

What is claimed is:

1. An AM receiver for receiving compatible stereo signals having the form $(1+L+R)\cos(\omega_c t+\phi)$ where L and R represent first and second intelligence signals, $\omega_c t$ is a carrier frequency signal, and $\phi$ is arc tan $\{(L-R)/(1+L+R)\}$ and comprising in combination:

input means for receiving said signal and deriving therefrom an intermediate frequency signal;

envelope detector means coupled to the input means for detecting the amplitude modulation on the intermediate frequency signal;

synchronous detector means coupled to the input means for providing an output proportional to $(L-R)\cos\phi$;

corrector means coupled to the synchronous detector means for providing an output proportional to L−R; and matrix means for processing the L−R; and L+R signals to provide separate L and R outputs.

2. An AM receiver for receiving compatible stereo signals having the form $(1+L+R)\cos(\omega_c t+\phi)$ where L and R represent first and second intelligence signals, $\omega_c t$ is a carrier frequency signal, and $\phi$ is arc tan $[(L+R)/(1+L+R)]$ and comprising in combination:

input means for receiving said signal and deriving therefrom an intermediate frequency signal;

envelope detector means coupled to the input means for detecting the amplitude modulation on the intermediate frequency signal;

first circuit means coupled to the input means for providing an output related to the phase of the received carrier signal;

second circuit means for providing an output related to the phase of the unmodulated carrier signal;

third circuit means for providing a signal proportional to $\cos\phi$;

synchronous detector means coupled to the output of the second circuit means for providing an output proportional to $(L-R)\cos\phi$;

divider means coupled to the synchronous detector means and to the third circuit means for providing an output proportional to (L−R); and matrix means for processing the L−R and L+R signals to provide separate L and R outputs.

3. An AM receiver according to claim 2 wherein the second circuit means is coupled to an output of the first circuit means.

4. An AM receiver according to claim 2 wherein the third circuit means is coupled to outputs of the first and second circuit means.

5. An AM receiver for receiving compatible stereo signals having the form $(1+L+R)\cos(\omega_c t+\phi)$ where L and R represent first and second intelligence signals, $\omega_c t$ is a carrier frequency signal, and $\phi$ is arc tan $\{(L-R)/(1+L+R)\}$ and comprising in combination:

input means for receiving said signal and deriving therefrom an intermediate frequency signal;

envelope detector means coupled to the input means for detecting the amplitude modulation on the intermediate frequency signal;

first circuit means coupled to the input means for providing an output related to the phase of the received carrier signal;

second circuit means coupled to the first circuit means for providing an output related to the phase of the unmodulated carrier signal;

third circuit means coupled to the first and the second circuit means for providing a signal proportional to $\cos\phi$.

synchronous detector means coupled to the output of the second circuit means for providing an output proportional to $(L-R)\cos\phi$;

divider means coupled to the synchronous detector means and to the third circuit means for providing an output proportional to L−R; and matrix means for processing the L−R and L+R signals to provide separate L and R outputs.

6. An AM receiver according to claim 5 wherein the first circuit means comprises a limiter circuit for removing amplitude modulation and providing a signal proportional to $\cos(\omega_c t+\phi)$.

7. An AM receiver according to claim 5 wherein the second circuit means comprises a phase locked loop.

8. A receiver for receiving compatible AM stereo signals having the form $(1+L+R)\cos(\omega_c t+\phi)$ where L and R represent first and second intelligence signals, $\omega_c t$ is a carrier frequency signal, and $\phi$ is arc tan $\{(L-R)/(1+L+R)\}$ and comprising in combination:

input means for receiving said AM stereo signal and deriving therefrom an intermediate frequency signal;

first circuit means coupled to the input means for generating a first intermediate signal proportional in amplitude to the amplitude modulation in said received AM stereo signal;

second circuit means coupled to the input means for generating a second intermediate signal proportional to $(L-R)\cos\phi$;

third circuit means for generating a third intermediate signal proportional to $\cos\phi$;

means for dividing the second intermediate signal by the third intermediate signal; and matrix means for processing the output of the divider means with the first intermediate signal to provide separate outputs proportional to L and R.

9. A receiver according to claim 8 wherein the input means comprises antenna means and means for selecting and mixing the received signal to provide a corresponding intermediate frequency signal.

10. A receiver according to claim 8 wherein the first circuit means comprises envelope detector means.

11. A receiver according to claim 8 wherein the second circuit means comprises synchronous detector means.

12. A receiver according to claim 8 wherein the third circuit means comprises a phase locked loop and a multiplier.

13. A receiver for receiving a broadcast carrier wave which is amplitude modulated with signal information proportional to the sum of first (A) and second (B) intelligence signals, and which is phase modulated with a signal proportional to an angle $\phi$ having the form $\phi = \text{arc tan } \{c_1(A-B)/(C_2+A+B)\}$ where $C_1$ and $C_2$ are constants, the receiver comprising in combination:

input means for receiving and amplifying the broadcast carrier wave;

means coupled to the input means for translating the broadcast carrier wave to one of an intermediate frequency;

envelope detector means coupled to the translating means for providing a sum signal proportional to the amplitude modulation in the received AM stereo signal;

synchronous detector means coupled to the translating means for providing a first signal proportional to $(A-B)\cos\phi$;

corrector means for providing a second signal proportional to $\cos\phi$.

means for dividing the first signal by the second signal; and matrix means for processing the outputs of the divider means and the envelope detector means to provide separate outputs proportional to A and B.

14. A receiver for receiving compatible AM stereo signals having the form $(1+L+R)\cos(\omega_c t+\phi)$ were L and R represent first and second intelligence signals, $\omega_c t$ is a carrier frequency signals, and $\phi$ is arc tan $\{(L-R)/(1+L+R)\}$ comprising:

input means for receiving said signal and deriving therefrom an intermediate frequency signal;

first circuit means coupled to the input means for deriving the sum signal directly from the amplitude modulation of the intermediate frequency signal;

second circuit means coupled to the input means for deriving a signal proportional to $(L-R)\cos\phi$;

third circuit means for deriving a $\cos\phi$ correction factor for the difference signal;

divider means for dividing the output of the second circuit means by the output of the third circuit means to provide the difference signal; and means for matrixing the sum and difference signals to provide L and R outputs.

15. A receiver according to claim 14 wherein the first circuit means comprises an envelope detector, and the second circuit means comprises a synchronous detector and the third circuit means comprises limiter means, phase locked loop means and cosine phase detector means.

* * * * *

UNITED STATES PATENT AND TRADEMARK OFFICE

CERTIFICATE OF CORRECTION

PATENT NO. : 4,192,968

DATED : March 11, 1980

INVENTOR(S) : Francis H. Hilbert and Norman W. Parker

It is certified that error appears in the above-identified patent and that said Letters Patent are hereby corrected as shown below:

In the Abstract, line 2, delete "signal" and insert --signals--.

Column 2, delete lines 27 and 28 and insert --$(L - R)/\sqrt{(L - R)^2 + (1 + L + R)^2}$ and the cosine of this angle is $(1 + L + R)/\sqrt{(L - R)^2 + (1 + L + R)^2}$. Substi- --.

Column 2, delete line 31 and insert --$(1 + L + R)(L - R)/\sqrt{(L - R)^2 + (1 + L + R)^2}$ which--.

Column 2, line 39, delete "22 the" and insert --22. The--.

Column 2, delete line 47 and insert --$(1 + L + R)/\sqrt{(1 + L + R)^2 + (L - R)^2}$. When the desired--.

Column 3, line 2, delete "$\omega_3 t$" and insert --$\omega_c t$--.

Column 3, delete line 10 and insert --$\phi = \arctan[(L - R)/(1 + L + R)]$. The output of the--.

Column 3, line 50, delete ";".

Column 3, line 56, delete "$[(L + R)/(1 + L + R)]$" and insert --$[(L - R)/(1 + L + R)]$--.

Column 5, line 21, delete "$\arctan\{c_1(A - B)/(C_2 + A + B)\}$" and insert --$\arctan\{C_1(A - B)/(C_2 + A + B)\}$--.

UNITED STATES PATENT AND TRADEMARK OFFICE

CERTIFICATE OF CORRECTION

PATENT NO. : 4,192,968

DATED : March 11, 1980

INVENTOR(S) : Francis H. Hilbert and Norman W. Parker

It is certified that error appears in the above-identified patent and that said Letters Patent are hereby corrected as shown below:

Column 6, line 12, delete "were" and insert --where--.

Signed and Sealed this

*Twenty-ninth* Day of *July 1980*

[SEAL]

*Attest:*

SIDNEY A. DIAMOND

*Attesting Officer*

*Commissioner of Patents and Trademarks*